US006601832B1

(12) United States Patent
Palmu

(10) Patent No.: US 6,601,832 B1
(45) Date of Patent: Aug. 5, 2003

(54) DEVICE FOR SUCKING GAS AND MIXING IT WITH A FUEL FLOW

(76) Inventor: Markku Juhani Palmu, Anden Kirchenäckern 7, D-65817 Eppstein (DE)

( * ) Notice: Subject to any disclaimer, the term of this patent is extended or adjusted under 35 U.S.C. 154(b) by 0 days.

(21) Appl. No.: 10/009,978

(22) PCT Filed: Jun. 15, 2000

(86) PCT No.: PCT/FI00/00536

§ 371 (c)(1),
(2), (4) Date: Apr. 22, 2002

(87) PCT Pub. No.: WO00/76646

PCT Pub. Date: Dec. 21, 2000

(30) Foreign Application Priority Data

Jun. 15, 1999 (FI) ..... 991368

(51) Int. Cl.[7] ..... F02M 61/04
(52) U.S. Cl. ..... 261/64.3; 261/76; 261/DIG. 75
(58) Field of Search ..... 261/76, 64.3, DIG. 75; 123/590; 417/151, 167, 168

(56) References Cited

U.S. PATENT DOCUMENTS

| | | | | | |
|---|---|---|---|---|---|
| 1,491,057 | A | * | 4/1924 | Myers | 417/174 |
| 3,282,227 | A | * | 11/1966 | Nielsen | 417/167 |
| 3,373,978 | A | * | 3/1968 | Ellis | 261/16 |
| 4,041,981 | A | * | 8/1977 | Davis et al. | 261/64.1 |
| 4,178,134 | A | * | 12/1979 | Babish et al. | 417/181 |
| 4,325,341 | A | | 4/1982 | Yamauchi et al. | 123/472 |
| 4,562,014 | A | * | 12/1985 | Johnson | 261/64.1 |
| 4,708,829 | A | * | 11/1987 | Bylehn et al. | 261/62 |
| 4,743,405 | A | * | 5/1988 | Durao et al. | 261/76 |
| 4,842,777 | A | * | 6/1989 | Lamort | 261/79.2 |
| 5,004,484 | A | * | 4/1991 | Stirling et al. | 95/263 |
| 5,890,477 | A | * | 4/1999 | Nazare | 123/592 |
| 6,237,897 | B1 | * | 5/2001 | Marina | 261/64.1 |
| 6,290,917 | B1 | * | 9/2001 | Yamamoto | 422/159 |

FOREIGN PATENT DOCUMENTS

| | | |
|---|---|---|
| DE | 295 14 973 | 3/1997 |
| EP | 0 417 776 | 3/1991 |
| EP | 0 607 166 B1 | 8/1995 |
| EP | 0 814 254 | 12/1997 |
| FR | 2 315 983 | 1/1977 |
| GB | 992494 | 5/1965 |
| GB | 2 278 639 | 12/1994 |
| WO | WO 92/13188 | 8/1992 |
| WO | WO 93/03830 | 3/1993 |
| WO | WO 93/12385 | 6/1993 |
| WO | WO 96/15848 | 5/1996 |

* cited by examiner

*Primary Examiner*—Richard L. Chiesa
(74) *Attorney, Agent, or Firm*—Young & Thompson

(57) ABSTRACT

The invention relates to a device for sucking air and mixing it with a liquid fuel flowing in a tubular flow duct. The device has a liquid intake duct (3) and outlet duct (4) and between them a throttle section (1), which forms a substantially reduced flow cross-sectional area for the flow. The throttle section has for the flowing liquid fuel at minimum one throttle duct (6*a*, 6*b*), which extends with substantially the same flow cross-sectional area from the point of the closest air supply orifice (21) to a distance of a downstream length (L2) which is at minimum equal to the mean diameter of the flow cross-sectional area (A2*a*, A2*b*) of the throttle ducts. The throttle section has transverse gas ducts (2), which open into the throttle ducts (6*a*, 6*b*) on the first side of a plane running through the throttle duct center line (8) and which continue as a connecting duct (7) outside the throttle ducts to the opposite side of the said plane and further to the gas/gas mixture source (20).

28 Claims, 4 Drawing Sheets

DEVICE FOR SUCKING GAS AND MIXING IT WITH A FUEL FLOW

The invention relates to a device for sucking a gas or a gas mixture and for mixing it with a liquid fuel flowing in a flow duct provided with walls, the device comprising: an intake duct and an outlet duct for the liquid, the ducts having first flow cross-sectional areas; a throttle section between the intake and outlet ducts, the throttle section comprising at least one elongate throttle duct for the flowing liquid fuel; and at least one gas duct, transverse to the center line of the throttle duct, which opens as a gas supply orifice to the throttle duct, the said throttle duct forming for the flow a second flow cross-sectional area, which is substantially smaller than the said first flow cross-sectional area, and extending with a substantially unchanging flow cross-sectional area from the said gas supply orifice to a downstream distance on the downstream side of the liquid flow.

Publications EP-0 417 776 and EP-0 607 166 describe devices which include in the flow-through duct for the flowing medium a plug which considerably reduces the flow cross-sectional area, whereby, as is known, the flow velocity is increased and underpressure is produced at the point of the rapid flow. The plug is hollow, and its wall has, at a distance from the narrowest point of the gap between the plug and the flow-through duct on the downstream side of the flow, a small orifice, whereby a supply passage is created for the additive via the hollow interior of the plug and the small orifice. The above-mentioned underpressure at the point of the rapid flow sucks the additive via the small orifice into the flowing medium. The purpose is to enable an additive to be introduced also into a medium having a high viscosity, such as a gel, and to enable an additive to be introduced into a flow of a medium having a high discharge resistance. It is possible that the device described in the publications works in some manner in the conditions mentioned above, but when the flowing medium is a fuel in liquid state, such as diesel oil, fuel oil, kerosene, or the like, the flow rate of which varies within a wide range and may additionally change suddenly, and the additive supplied is a gas, such as air or oxygen, considerable problems are encountered. First, if the device according to the publications is calibrated to supply a correct gas amount into a small liquid flow, the device will not suck a sufficient amount of gas into the liquid at a high liquid flow rate. Although the increasing of the liquid flow rate does somewhat increase the underpressure, and thus the amount of gas sucked in, the gas amount does not increase to a sufficient degree. As the liquid flow increases and its velocity increases, another problem is encountered, namely, the foaming of the liquid, for which liquid fuels have a tendency and which appears when the underpressure drops sufficiently low at the point of the small cross-sectional area, regardless of whether or not there is a sufficient amount of gas entering the liquid flow. Publication EP-0 607 166 additionally describes in the additive duct a valve the purpose of which is to control the amount of additive. This is, however, a one-way valve equipped with a straight valve disc, and the valve cannot serve to control the amount, since it has only two positions, open and shut. In a structure such as this, a disturbance in the steady flow of medium, such as its sudden decrease, which is usual or regular when the device is used in a liquid fuel flow, leads to a situation in which the medium flows backward into the additive duct and all the way to the one-way valve. The result is the blocking of the additive duct and/or the one-way valve.

Publications WO-96/15848 and DE-295 14973 U1 describe arrangements corresponding to that described above for introducing an additive, such as air, into diesel oil or fuel oil. In these publications, the structure of the device in the area of the liquid duct is precisely of the type discussed in the preceding paragraph, but they additionally have a device for drying the feed air in order to decrease the relative humidity of the air. Decreasing the humidity of the air does not in the least help to solve the problems described in the preceding paragraph.

Publication WO-93/12385 describes a device arranged in the fuel supply of a heating boiler in order to inject air into a liquid fuel so that a large, number of small bubbles are formed in it. For this purpose the device includes an air bubble device, of which there are presented as embodiments a jet pump (diffusion pump), a Venturi tube, and a flow duct provided with throttling. In the throttled flow duct the intake cross-sectional area is approximately equal to the outlet cross-sectional area, and the flow-through cross-sectional area between them is much smaller than the intake/outlet cross-sectional areas, and the smallest cross-sectional area is constant within a certain distance, which is a multiple of the corresponding diameter. It is seen from the figures that the air duct comes directly to the throttle duct, and that the apparatus does not include a one-way valve opening under a certain pressure. The purpose of the air bubbles is to improve gasification of the fuel in the oil burner. Such air bubbles may indeed work in the manner intended in the publication when used in a heating boiler oil burner, in which the burner nozzle supplies fuel into a furnace under atmospheric pressure or slight underpressure. In this case the fuel pump is required to produce only a relatively low pressure, in which case the air bubbles present in the liquid fuel will perhaps not badly disturb the operation of the pump. Furthermore, in the said use the liquid fuel flow is always constant during combustion, i.e. in heating boilers the control is always so-called two-point control, i.e. the burner either operates at full power—in which case the fuel flow is always of a constant magnitude—or the burner is not at all in operation—in which case there is no fuel flow. When a combustion engine, such as a diesel engine, is concerned, it is necessary to supply fuel for very short moments, at a varying fuel flow rate and under a very high pressure, in which case the air bubbles, being compressible, cause uncontrolled changes in the fuel supply and spoil the operation of the engine. Furthermore, in a combustion engine a strongly varying flow tends to cause a back flow of fuel and, because of capillary effect, into the air ducts, where the fuel will block the small ducts, preventing further operation of the device, since the underpressure caused by the flow in the throttle is not, owing to the capillary forces, sufficient to remove the liquid fuel from the gas ducts. This problem is not solved by the construction according to the publication.

Publication EP-0 814 254 A1 discloses a mixing device for introducing air into fuel oil. The device does have an intake duct and throttle, and an air intake duct opening into it, but immediately on the downstream side there is specifically an expansion connected with the throttle, without any unchanging portion. The optimum value of the cross-sectional area of the throttle is defined as 2.5–3.8 $mm^2$, and the optimum value of the cross-sectional area of the air ducts is defined as 0.013–0.025 $mm^2$. The magnitude of the throttle in proportion to the intake/outlet duct, i.e. the desired underpressure, is not defined in the publication. The aim in the publication is specifically the foaming of the fuel oil which is arrived at by arranging the ratio of the cross-sectional area of the throttle to the cross-sectional area of the air ducts to be 100:1–290:1. The said expansion of the downstream side increases this foaming. The duct expansion is always open, and the air is introduced, in the case of one air duct, into the throttle directly from the same side on which it is taken from the outside. The publication also discloses embodiments having a plurality of air ducts, but in them air is supplied into the throttle from all of its sides. The objects of the publication, and the foam-like liquid fuel obtained thereby, do not work in a combustion engine, for the same reasons as stated above with respect to publication WO-93/12385.

One object of the present invention is thus to provide a device for sucking a gas or a gas mixture and for mixing it with a liquid fuel flowing in a flow duct provided with walls, in such a manner as to obtain in the liquid fuel, with practicable precision, the same gas content desired in the given case, regardless of the flow-through rate of the liquid fuel, at least when the flow-through rates are substantially variable. Another object of the invention is to provide a device of this type which would not produce foam in the liquid fuel flowing therein, or at least this foaming tendency would be minimal. A third object of the invention is to provide a device of this type, wherein the gas introduced into the liquid fuel within the throttle section would not have the tendency later to separate from the liquid fuel or this separation tendency would at least be minimal. A fourth object of the invention is to provide a device of this type, wherein the flow of liquid fuel into supply ducts for a gas or a gas mixture would be minimal in all operating situations in connecting with engines or burners or other devices using a liquid fuel. A further object of the invention is a device of this type, which would be simple and the operation of which would not require a control power source separate from the liquid fuel flow.

The disadvantages described above can be eliminated and the objects defined above can be implemented by means of the device according to the invention.

The following facts can be mentioned as advantages of the device according to the invention. Foam does not tend to be formed in the liquid fuel flowing through the device, and thereby disturbances in the supply of liquid fuel into its combustion chamber are avoided. Furthermore, in the device there is not a tendency for the liquid fuel to flow in a non-intended manner into the supply ducts for the gas or the gas mixture, and thereby disturbances in the flow of the gas/gas mixture are avoided, since the ducts intended for the gas/gas mixture remain cleaner of liquid fuel than in prior-known devices. With the help of the device of the invention, the specific amount of gas or gas mixture introduced into the liquid fuel will remain in it and will not tend to separate from the liquid fuel, wherein there is, of course, the restricting factor of the solubility of the gas/gas mixture in the liquid fuel. In prior-known devices, separation of the gas/gas mixture tends to occur even if the amount supplied ought to dissolve in the liquid fuel. By means of the device of the invention, air can thus be caused to dissolve in a liquid fuel, which thus remains a liquid and will not in any case turn into foam or gas. The device according to the invention can easily be supplemented and calibrated in accordance with the invention so that the amount of the gas/gas mixture supplied corresponds quite precisely to the desired concentration in the liquid fuel also at considerably different flow rates of the fuel, varying during operation. Furthermore, the device has the advantage that the device operates with merely the liquid fuel flow, in which case no control means driven electrically or with other pneumatics or other hydraulics are needed.

BRIEF DESCRIPTION OF THE DRAWINGS

The invention is described below in detail, with reference to the accompanying drawings.

DETAILED DESCRIPTION OF THE PREFERRED EMBODIMENTS

Figure 1:
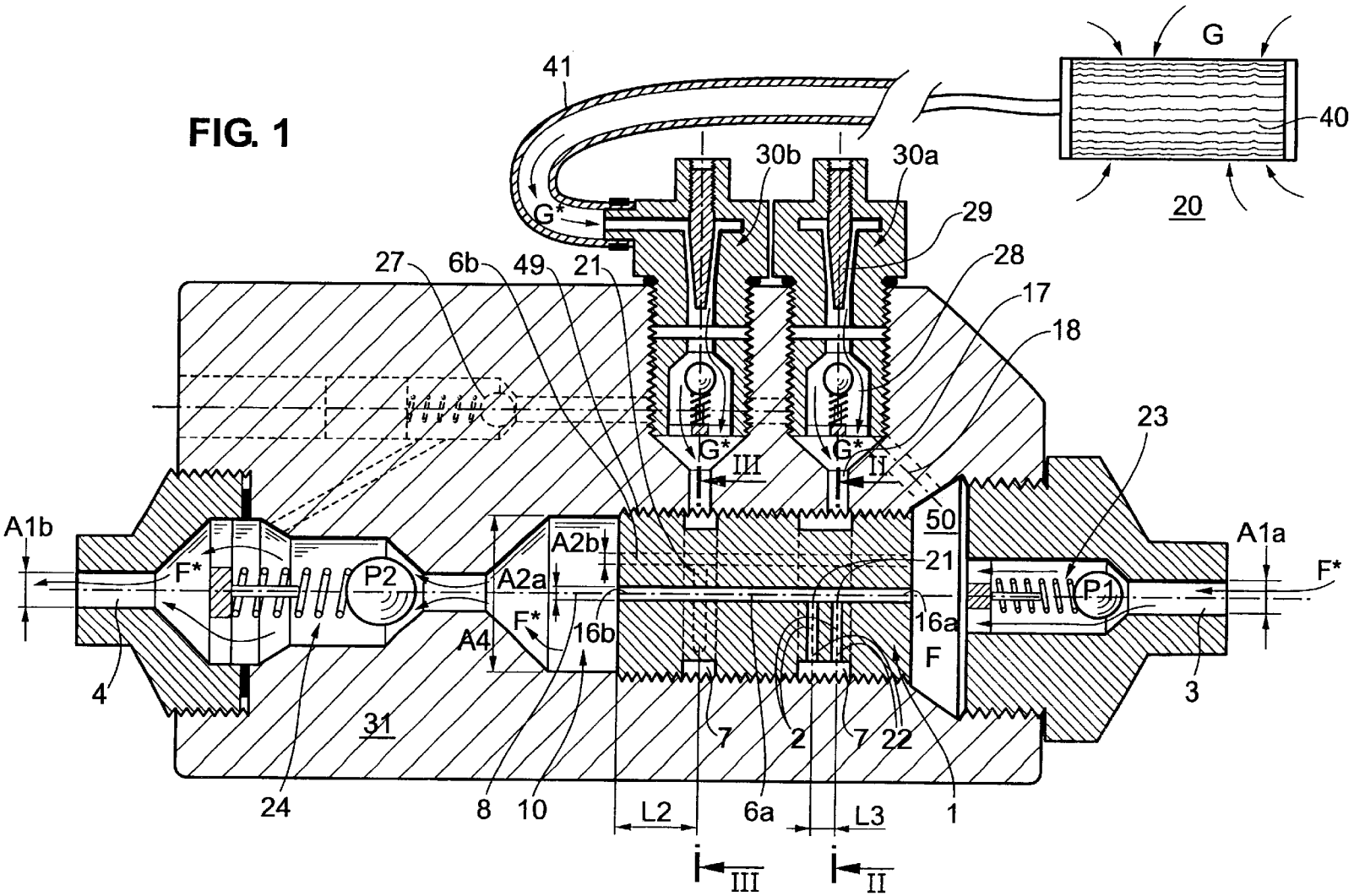
FIG. 1 depicts one embodiment of the device according to the invention in its entirety in a longitudinal section through plane I-I in FIG. 2.

FIG. 1 shows generally a device for the sucking of a gas, such as oxygen, or of a gas mixture, such as air, and for mixing it with a liquid fuel F, such as combustible oil, which flows in a flow duct provided with walls and which is burned in a burner, not shown in the figures, or an engine, not shown in the figures. The liquid fuel is here a fuel which, at least at this point of fuel feed, is definitely liquid, and the flow of liquid fuel is indicated by F*. The combustible oil may be, for example, heating oil, heavy fuel oil, diesel oil, kerosene, gasoline, etc. The invention is thus not relate to the introduction of a gas or a gas mixture into, for example, dust-like, i.e. in principle solid, fuel and not to the introduction into a gaseous fuel. It is a different matter that in the case of the device according to the invention the liquid fuel F later gasifies or is gasified for combustion. The object of the invention is specifically to obtain a liquid fuel containing oxygen or air dissolved therein so that this oxygen-enriched fuel can further be treated in a closed duct. The gas or gas mixture G dissolved in the liquid fuel F must not separate from the liquid during any further transfers of the liquid. Thus the invention in no way relates to the gasification of fuel, which is carried out substantially later and for the actual combustion process. Also, the invention does not relate to the introduction of a gas or a gas mixture into a liquid which is stationary and/or has an open surface relative to the surroundings. The invention thus relates to those situations which concern, for example, a combustible liquid F which is flowing, for example, to a burner or an engine or other targeted use and which must be as well as possible insulated/separate from the surroundings, such as engine parts causing a risk of ignition, and which must not even otherwise leak into the environment. The fuel F must thus flow in a duct, such as a pipe or a hose, tightly closed relative to the environment.

For this purpose the device has as basic parts a frame part 31 and therein a liquid fuel F intake duct 3 and outlet duct 4, which have first flow cross-sectional areas A1*a* and respectively A1*b*. The intake duct 3 is connected to a liquid fuel container, not shown in the figures, which may be of any known or old type. The outlet duct, for its part, is connected to a burner, an engine, or a corresponding drive device. Inside the frame part 31 there is between the intake duct 3 and the outlet duct 4 a throttle section 1, which forms for the flow F* of the liquid fuel F a second flow cross-sectional area A2, which is substantially smaller than the said first cross-sectional areas A1*a* and A1*b*. The first cross-sectional areas A1*a* and A1*b* are in general equal or approximately equal in size, but they may deviate from each other considerably, which, according to the knowledge at present, has hardly any significance in terms of the invention. The throttle section 1 has, opening into it, at least one gas supply orifice 21, via which oxygen or air G is supplied as a gas flow G* into the liquid fuel flow F*. It is most expedient to use as the oxygen source 20 ambient air G, i.e. the atmosphere, in which case air G is sucked through an air filter 40 and further in a closed pipe or hose as a flow G* into the mixing device according to the invention.

Figure 2:
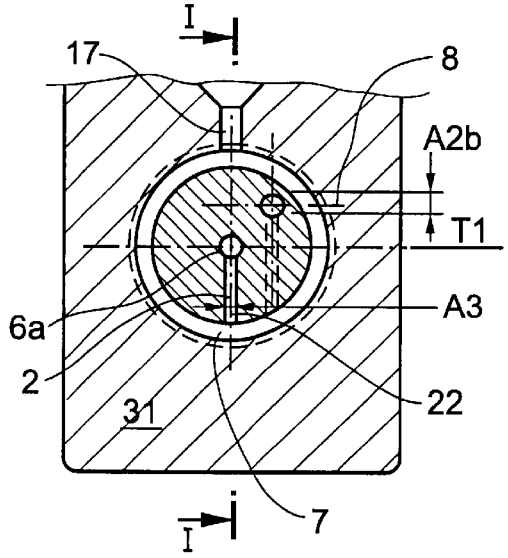
FIG. 2 depicts a cross-section of those parts of the device of FIG. 1 which are in direct contact with the liquid fuel flow, in the area of one gas duct system and through plane II-II in FIG. 1.
Figure 3:
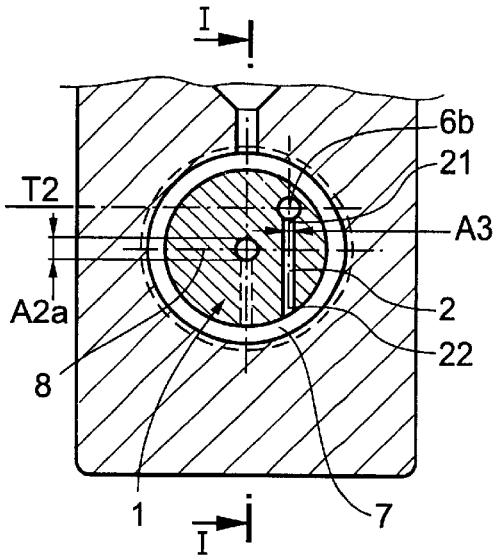
FIG. 3 depicts a cross-section of those parts of the device of FIG. 1 which are in direct contact with the liquid fuel flow, in the area of another gas duct system and through plane III-III in FIG. 1.
Figure 4:
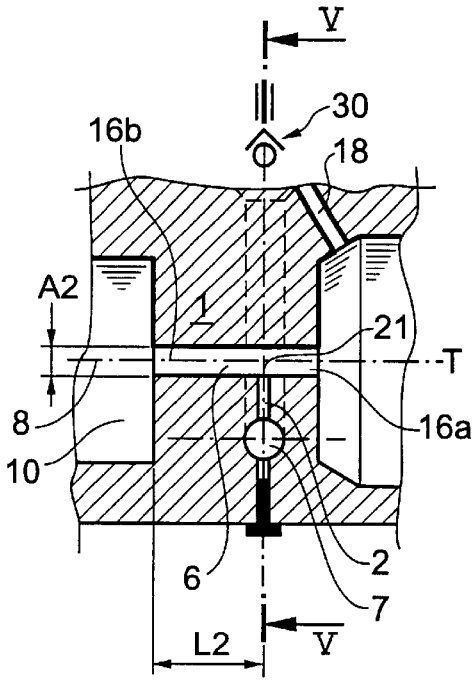
FIG. 4 depicts those parts of another embodiment of the invention which are in direct contact with the liquid fuel flow, in a longitudinal section through plane IV-IV in FIG. 5.
Figure 5:
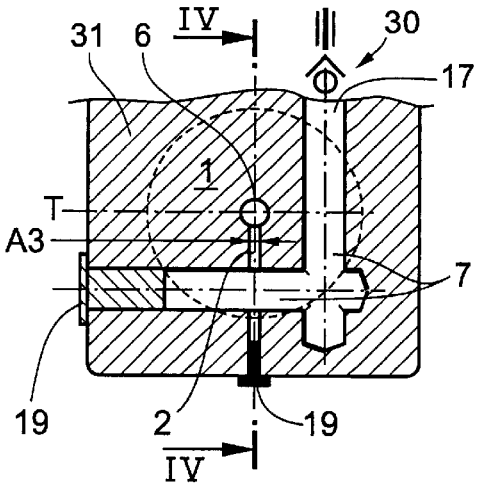
FIG. 5 depicts a cross-section of the device parts of FIG. 4, in the area of the gas ducts and through plane V-V in FIG. 4.

The throttle section 1 according to the invention comprises, first, at least one elongate throttle duct 6, as in the embodiment of FIGS. 4–5, or two throttle ducts 6*a* and 6*b*, as in the embodiment of FIGS. 1–3, or more throttle ducts 6*a*, 6*b*, 6*c*, for the flowing liquid fuel. The two or more throttle ducts 6*a*, 6*b*, etc., are coupled in parallel relative to the liquid flow F*. Each throttle duct 6, 6*a*, 6*b*, 6*c*, or the combination thereof, forms the said second flow cross-sectional area A2; A2*a*, A2*b*, A2*c* in such a manner that the sum of these second flow cross-sectional areas is substantially smaller than the first flow cross-sectional area, i.e. A2<<A1*a* and A1*b*, and $\Sigma$(A2*a*+A2*b*+A2*c*+ . . . )<<A1*a* and A1*b*. Into each throttle duct there opens at least one gas duct 2 via at least one gas supply orifice 21. In particular the throttle ducts 6, 6*a*, 6*b*, 6*c* extend, with a substantially unchanging flow cross-sectional area, from the point of the gas supply orifice 21 in the direction of the liquid flow F* on the downstream side to the distance of downstream length L2, which is at least equal to the mean diameter of the throttled flow cross-sectional area A2; A2*a*, A2*b*, A2*c*. The downstream length L2 is measured from the gas supply orifice 21 closest to the downstream end 16*b* of the throttle duct when the throttle duct concerned has several gas supply orifices. Preferably the said second flow cross-sectional area A2; A2*a*, A2*b*, A2*c* of the throttle duct extends with substantially the same flow cross-sectional area to the distance of a downstream length L1 which is at least twice, and typically five times, the mean diameter of the throttled flow cross-sectional area. It is known that the throttling of a flow accelerates the flow and lowers the pressure at the throttle point This lowered pressure, i.e. underpressure $P_A$, in the throttle duct 6, 6*a*, 6*b*, 6*c* causes the suction of air or other gas or gas mixture G from the gas/gas mixture source 20, such as the atmosphere, via gas ducts 2 and connecting ducts 7, to be described below, and further via the gas supply orifice 21 into the liquid fuel F flowing at a high rate in the throttle duct. By means of this unchanging cross-sectional area of the throttle ducts over a sufficient downstream length L2, the air G or the like sucked into the liquid fuel is caused to remain in the liquid fuel so that it will not even later tend to separate from the liquid. In this manner at least almost that amount of gas G which can theoretically dissolve in the liquid fuel concerned at the temperature concerned can be caused to dissolve in the liquid fuel F. By a substantially unchanging flow cross-sectional area is meant here that the cross-sectional area A2; A2*a*, A2*b*, A2*c* of the throttle duct changes over the downstream length L2 at maximum 30%, preferably at maximum 20%, and typically at maximum 10%, from the point of the gas supply orifice 21 in the direction of the liquid flow F* to the end of the downstream length L2 on the downstream a side. Typically the cross-sectional area of the throttle duct remains, within the limits of the precision of normal machining, such as the drilling of a bore, the same over this downstream length L2.

Figure 6:
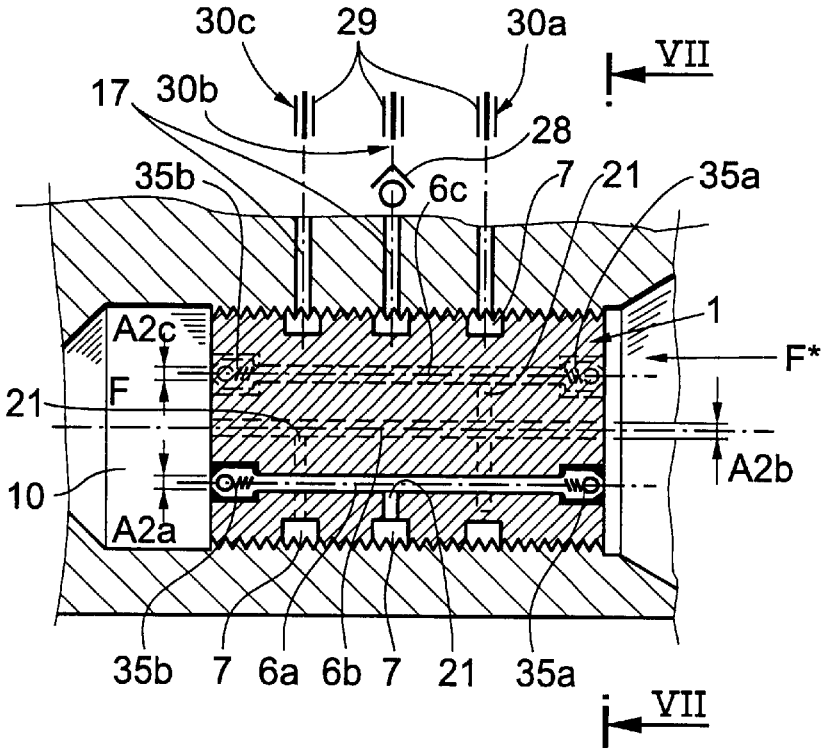
FIG. 6 depicts those parts of a third embodiment of the invention which are in direct contact with the liquid fuel flow, in a longitudinal section through plane VI-VI in FIG. 7.
Figure 7:
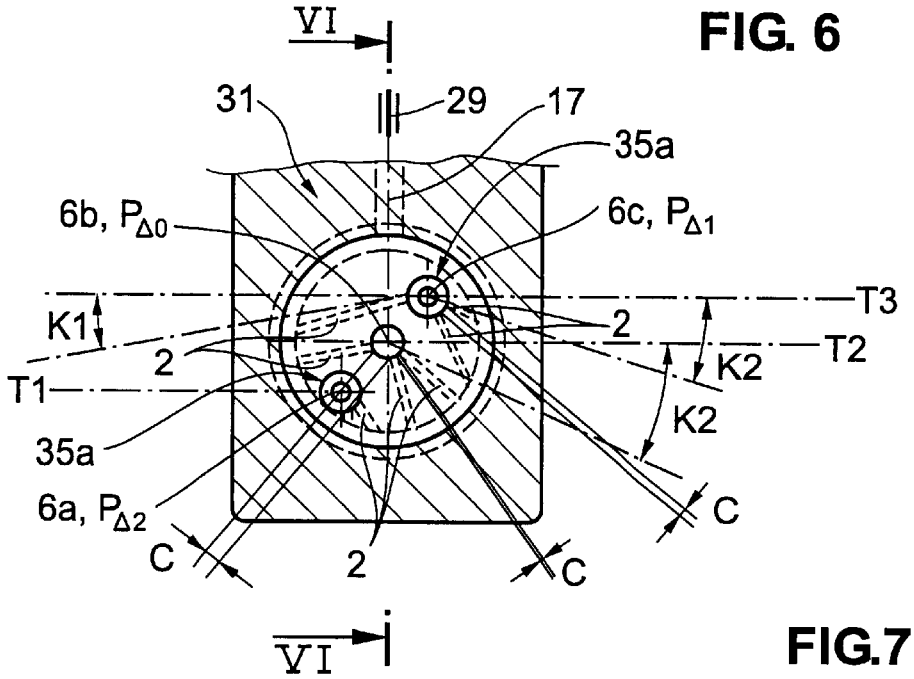
FIG. 7 depicts a cross-section of the device parts of FIG. 6, as seen from the upstream end of the throttle ducts and through plane VII-VII in FIG. 6.

Furthermore, the throttle section 1 according to the invention comprises at least one gas duct 2, transverse to the center line 8 of each throttle duct, the gas duct opening as a gas supply orifice 21 into the throttle duct 6; 6*a*, 6*b*, 6*c* at least in the main on the first side of a plane T; T1, T2, T3 running through its center line. The gas duct 2 continues as a connecting duct 7 outside the throttle duct 6; 6*a*, 6*b*, 6*c* to the opposite side of the said plane T; T1, T2, T3, and further to the source 20 of the gas/gas mixture. This thus means that the combinations of the gas duct or gas ducts 2 and the connecting duct or connecting ducts 7 make a curve outside the throttle duct or around it so that on the first side of the curve the gas duct 2 points on one side of the plane running through the center line 8 of the throttle duct towards the throttle duct and opens into it through a supply orifice 21, and on the other side of the curve the connecting duct 7 extends to the opposite side of this plane, in which case it may in principle point in the same direction as the supply orifice 21 on the said first side of the curve. If the throttle section 1 has several throttle ducts 6; 6*a*, 6*b*, 6*c*, the planes T; T1, T2, T3, discussed above, running through their center lines are specifically parallel or at least in the main parallel. In this case the possible several connecting ducts 7 must extend to the other side of the planes disposed farthest from each other, i.e. in FIGS. 6 and 7 to above plane T3, and in FIGS. 1–3 to above plane T2. However, each gas duct 2 connected with a throttle duct needs to be only on the first side of its own plane, as can be seen clearly in FIG. 7. This gas flow circulation described above from one side of the throttle ducts to the other side prevents liquid fuel from flowing in a non-intended direction, and the ducts, i.e. at least the connecting duct(s) 7, will remain clean of liquid fuel F even when the device is not in operation, i.e. when there is no flow F*. Without this design of the invention, the liquid fuel could flow in the connecting ducts and block them or any components therein.

Figure 8:
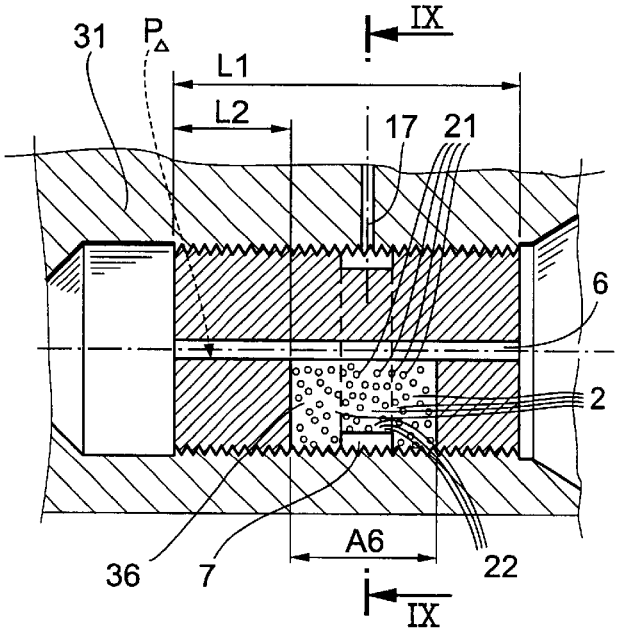
FIG. 8 depicts those parts of a fourth embodiment of the invention which are in direct contact with the liquid fuel flow, in a longitudinal section through plane VIII-VIII in FIG. 9.
Figure 9:
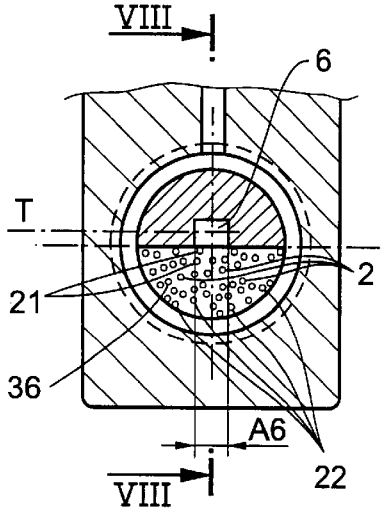
FIG. 9 depicts a cross-section of the device parts of FIG. 8, through plane IX-IX in the figure.
Figure 10:
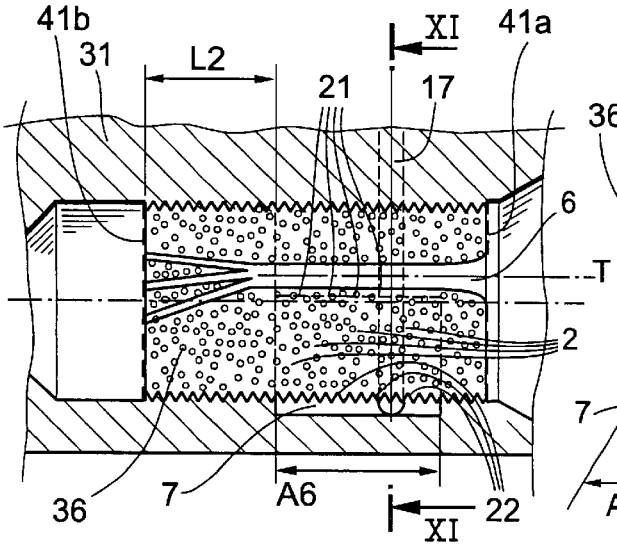
FIG. 10 depicts those parts of a fifth embodiment of the invention which are in direct contact with the liquid fuel flow, in a longitudinal section through plane X-X in FIG. 11.
Figure 11:
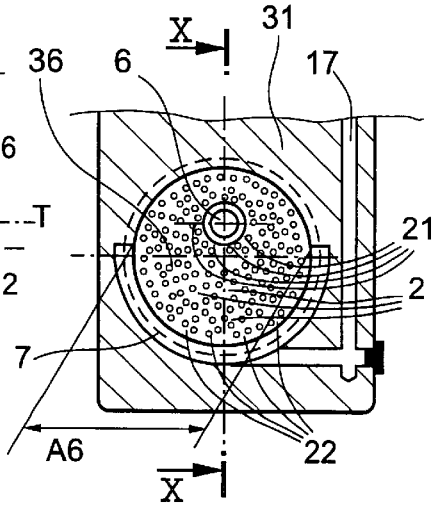
FIG. 11 depicts a cross-section of the device parts of FIG. 10, through plane XI-XI in the figure.

As a mechanical structure the device described above may, for example, include in the frame part 31 a recess 50 provided with inside threading 49, in which case the throttle section 1 comprises corresponding outside threading 49. The throttle section 1 may be made, according to one implementation principle of the invention, of a dense and strong material, such as a suitable plastic or metal. In this case the throttle ducts 6; 6*a*, 6*b*, 6*c* are bores machined either to be parallel to the threads 49, as in FIGS. 1–3 and 6–7, or possibly at a slant. However, the throttle ducts 6; 6*a*, 6*b*, 6*c* must extend through the throttle section 1 so that the upstream ends 16*a* of the throttle ducts communicate with the intake duct 3 and the downstream ends 16*b* communicate with the outlet duct 4. In addition, a throttle section such as this has a groove or grooves, parallel to the circumference, extending around the entire throttle section and forming an annular connecting duct 7 or, respectively, a plurality of annular connecting ducts 7. In the area of this annular connecting duct 7 there are formed, for example, by machining one or more gas ducts 2 transverse to the length L1 of the throttle ducts, the gas ducts typically connecting one throttle duct and one connecting duct on one side of the above-described plane T, T1, T2 or T3 of this throttle duct, as can be clearly seen in FIGS. 1–3 and FIGS. 6–7. A throttle section such as this can be easily screwed in place in the frame part and to the correct depth, whereupon the annular connecting ducts 7 settle in their correct positions in alignment with the connecting duct 7 extensions 17, transverse to the throttle ducts, in the frame part 31. At this point it is to be noted that for each annular connecting duct 7 and its extension 17 there is one or more gas ducts 2 extending to one throttle duct 6; 6*a*, 6*b*, 6*c*, as shown in FIGS. 1–3 and 6–7, or a plurality of gas ducts, as shown in FIGS. 8–9. In terms of manufacturing technology, the option described above is simple. The connecting duct 7 may also be shaped as an annular duct in the frame part 31. In the embodiment of FIGS. 10–11, wherein the throttle piece in its entirety is of a porous material 36, there is shown a structure such as this, wherein the connecting duct extends to that portion of the throttle section 1 circumference which is located on the above-described one side of a plane T running through the center line 8 of the throttle duct 6. If the throttle piece is not of a porous material but, instead, of the above-mentioned dense material and has gas ducts 2 formed therein in the manner defined above, even in this option the connecting duct can be extended over the entire circumference.

The embodiment of FIGS. 4–5 does not have a separate, i.e. separately made, throttle piece, but the throttle piece 1 is made up of a portion of the frame part 31. In this case also the throttle duct 6 or throttle ducts has/have been machined directly in the throttle piece 1 constituting a structural part of the frame part, as are the gas ducts 2 and the connecting ducts 7. The connecting ducts 7 and the gas ducts 2, for example, are drilled into the frame part from the outside in such a manner that they intersect each other and the gas duct(s) so that it/they extends/extend all the way to the throttle duct 6 or the throttle ducts. The open ends of the apertures on the surface of the frame part are closed with plugs 19 or the like. In other respects the throttle ducts, gas ducts and connecting ducts of even this option are placed and calibrated as defined earlier in this text.

According to the invention, the gas ducts 2, whether they are mechanically cut/machined in the throttle section or are made up of rows of pores in a porous material 36, can be oriented towards the throttle duct or ducts 6, 6*a*, 6*b*, 6*c* either radially or in parallel, or as combinations or intermediate forms thereof, or as an incidental combination of pores. In one embodiment of the invention, the gas supply orifices 21 of the gas ducts 2 open into the throttle ducts 6; 6*a*, 6*b*, 6*c* entirely on the first side of a plane T; T1, T2, T3 running through its center line, and these gas supply orifices are open into the throttle ducts within the sector the sides of which form, in relation to the said plane T; T1, T2, T3, an angle K1, K2, which is at least 10° or at least 30°. In another option of the invention, wherein the plurality of gas ducts is made up of rows of open pores in a porous material, 36, the plurality of gas supply orifices 21 of the plurality of gas ducts 2 opening into each throttle duct 6; 6*a*, 6*b*, 6*c* are located within the partial area A6 of the throttle-duct length L1 and the circumference, and the plurality of gas intake apertures 22 of these gas ducts for their part communicate with either one or more connecting ducts 7. The throttle section 1 surrounding the throttle duct or throttle ducts 6; 6*a*, 6*b*, 6*c* may be made up entirely or in part of the said porous material 36. At least in case the throttle section in its entirety is made up of, i.e. the throttle duct/throttle ducts are surrounded on all sides by, a porous material 36 which is relatively soft or resilient, the connecting duct(s) 7 is/are disposed in the manner described above in the frame part 31 surrounding this throttle section 1. Otherwise the connecting ducts 7 may be disposed according to need and to the manufacturing technique in the frame part 31 and/or the throttle section 1. In the connecting duct the gas intake apertures 22, i.e. to that end of the gas ducts or gas duct combinations produced by rows formed by pores, have an open portion of those ends which point away from the throttle duct, only on the said first side of the plane T; T1, T2, T3 running through the center line of the throttle duct. The said partial area A6 of the circumference ends at a distance of at least L2 from the downstream ends 16*b* of the throttle ducts and likewise, when the throttle section is in its entirety made of a porous material, the connecting duct 7, forming part of the circumference, ends at a distance of at least L2 from the downstream ends 16*b* of the throttle ducts. The connecting duct/connecting ducts 7 surround the porous material 36 substantially on the said first side of the plane (T; T1, T2, T3) running through the center line of the throttle ducts. Thereby the general principles of the invention, described earlier in this text, can be implemented, even though, owing to the structure of the material, the path of a single gas duct cannot be known precisely. In the event that the said porous material 36 forms only part of the wall of the throttle duct or ducts 6, 6*a*, 6*b*, 6*c*, according to the invention it is possible to use a piece which is located between the throttle duct 6; 6*a*, 6*b*, 6*c* and the connecting duct and only on the said first side of the plane T; T1, T2, T3 running through the center line 8 of the throttle duct. This porous material may be a metal, a metal alloy or a ceramic material or a suitable plastic, as long it is of a type which withstands chemically the fuel F and the operating temperature of the device of the invention without losing its properties which are essential in terms of the operation. Examples which can be mentioned of ceramic materials are porous glass, and of plastics, porous polytetrafluorethylene. The pores are open pores, i.e. they are open towards each other and outward, in which case a gas such as air can be sucked through it into the fuel, so that the pores form both the gas ducts 2 and the gas supply orifices 21 according to the invention; there being in this case large numbers of both of them. When necessary, that surface of such porous material forming the gas supply orifices which faces the inlet duct 3 can be protected with an end plate 41*a*, which prevents the entering fuel from penetrating the porous material 36, as indicated by a dotted line in FIG. 10. The porous material 36 may also be placed between two end plates 41*a*, 41*b*, for example to prevent a bypass flow between it and the frame part 31, especially if the porous material cannot be attached to the frame part by means of a compression joint or threading.

According to one preferred embodiment principle of the invention, there open into each throttle duct 6; 6*a*, 6*b*, 6*c* at least two gas ducts 2 at a distance L3 parallel to the downstream length L2 of the throttle duct and/or at a distance C parallel to the throttle duct circumference from one another. These several gas ducts communicate with one or, preferably, several connecting ducts 7. In the case of several connecting ducts 7 there is, in one embodiment of the invention, between the gas supply orifice/orifices 21 and the source 20 for the gas/gas mixture G one valve assembly 30; 30*a*, 30*b*, 30*c* for each connecting duct 7, the valve assembly being made up either of only a control valve 29 or of a combination of a one-way valve 28 and a control valve 29. According to another embodiment of the invention, two or more connecting ducts 7, whether they are connected with one or more throttle ducts, may be connected to each other for the purpose of sucking gas/gas mixture G, in which case they are thus together coupled to one valve assembly common to them. In the device of the invention there may be one or more of these. The one-way valves 28 are coupled in such an orientation that they let the gas/gas mixture G to flow G* from its source 20 towards the throttle ducts. In another embodiment of the invention, into each separate throttle duct 6 there opens one or more gas ducts 2 at a distance L3 parallel to the downstream length L2 of the throttle duct from one another and/or at a distance C parallel to the circumference of the throttle duct from each other, but all of the gas ducts leading to one of the throttle ducts 6; 6*a*, 6*b*, 6*c* are linked to a common connecting duct 7. Even in this case there is, between the gas supply orifice/orifices 21 and the gas/gas mixture G source 20, a separate valve assembly 30*a*, 30*b*, which is made up of a combination of a one-way valve 28 and a control valve 29. The valve assemblies are arranged to open each under a predetermined underpressure $P_\Delta$, usually different from those of the others, at the downstream end 16*b* of the throttle duct, as is described in greater detail below. Above there was thus noted the embodiment of the invention wherein, into one or several continuously open throttle ducts there open several gas ducts 2, which each in turn will begin to supply gas into the fuel F when a certain underpressure $P_\Delta$ value is exceeded. When the drive device, such as a burner or an engine, is in operation, but at low power, in which case the flow F* is small for example, the gas supply orifice 21 of only one gas duct is supplying gas under the effect of suction. When the power of the drive device is increased, as the flow F* accelerates and thereby the underpressure $P_\Delta$ increases, the gas supply orifices 21 of the subsequent gas ducts, one at a time, under the effect of suction will supply more gas into the flow of fuel F. In this option all of the throttle ducts are continuously open, and the amount of the gas G supplied under suction increases as the flow F* accelerates, whereupon the amount of gas supplied per one volume unit of liquid fuel increases somewhat. It is to be understood that, as the power of the drive device decreases, also the underpressure $P_\Delta$ decreases, and the amount of gas/gas mixture G supplied will decrease gradually. This is a reverse process as compared with the increasing of the power of the drive device.

In a further alternative and preferred embodiment of the invention, which has at least two throttle ducts 6*a*, 6*b*, 6*c*, one throttle duct 6*b* is continuously open, but the other throttle duct 6*a* and any further throttle duct 6*c* comprises at the upstream end 16*a* and/or downstream end 16*b* of the liquid flow F* a one-way valve 35*a* and/or 35*b* in such a manner that the one-way valves 35*a*, 35*b* of the various throttle ducts 6*a* and 6*c* are arranged to open under an underpressure $P_\Delta$ substantially deviating from those of the others, i.e. the various other valve assemblies, at the downstream end 16*b* of the throttle ducts. The one-way valves 35*a*, 35*b* are coupled in such an orientation that they allow the liquid fuel F to flow from the fuel container towards the drive device in direction F*. Here has thus been stated that embodiment of the invention wherein the throttle ducts will open and begin each in turn to let liquid fuel F through when a certain value of underpressure $P_\Delta$ is exceeded. When the drive device, such as a burner or an engine, is in operation, but with low power, in which case the flow F* is small, for example, the gas supply orifice 21 of only one gas duct of the throttle duct will, under the effect of suction, supply gas/gas mixture G into the liquid fuel of this throttle duct. When the power of the drive device is increased, as the flow F* accelerates and thus the underpressure $P_\Delta$ increases, the subsequent throttle ducts, one at a time, will begin to open and, under the effect of the underpressure $P_\Delta$ now produced in them as a result of this, the gas supply orifices 21 of these throttle ducts will begin, under the effect of suction, to supply more gas into the flow of liquid fuel F. In this option the throttle ducts are thus open or closed, depending on the strength of the flow F*, and the amount of the gas G supplied under suction increases as the total amount of the flow F* increases, but since the number of open throttle ducts, i.e. their total cross-sectional area $\Sigma A2_{a,b,c}$ increases, the amount of gas supplied per volume unit of liquid fuel will remain approximately the same. Since the throttle ducts open step by step, and their number is limited, the amount of gas/gas mixture G supplied per volume unit of liquid fuel F is, of course, theoretically not continuously precisely the same but varies within certain limits. However, in practice the variation can be regarded as being so slight that, when the values of the pressure differences opening the one-way valves 35*a*, 35*b*, etc., are suitably selected, the amount of gas/gas mixture per volume unit of liquid fuel can be set at a value very close to the optimum value. This optimum value is the gas concentration which will remain dissolved in the liquid fuel concerned. It is to be understood that, when the power of the drive device decreases, also the underpressure $P_\Delta$ decreases, whereupon the one-way valves 35*a*, 35*b*, etc., will close step by step and the amount of gas/gas mixture G supplied will decrease step by step. This is a reverse process compared with the increasing of the power of the drive device.

The structural options described in these two preceding paragraphs can be used, arranged in a suitable manner, even in one and the same device according to the invention. If the upstream end 16*a* and the downstream end 16*b* of any throttle duct 6 or 6*a* or 6*b* or 6*c* has one-way valves 35*a* and 35*b*, and gas/gas mixture G is supplied into the said throttle duct by only one connecting duct 7, it is advantageously sufficient that the connecting duct has only a control valve 29, which will be described later in this text. If a throttle duct has at the upstream end 16*a* and the downstream end 16*b* one-way valves 35*a* and 35*b*, but gas/gas mixture G is supplied into the said throttle duct by only two or by several connecting ducts 7, one of the connecting ducts is typically equipped with only a control valve but the other connecting ducts are equipped with valve assemblies 30*a*, 30*b* made up of a combination of a control valve 29 and a one-way valve 28. The underpressures $P_\Delta$ by which the one-way valves of these valve assemblies are opened must be greater than the underpressure $P_\Delta$ by which the one-way valves of the throttle duct are opened, and also preferably mutually of different magnitudes in a manner which will be described in the next two paragraphs. If the throttle duct 6 or 6*a* or 6*b* or 6*c* does not have one-way valves, then preferably all of the connecting ducts 7 supplying gas/gas mixture G into it have their own valve assemblies 30*a*, 30*b* made up of a combination of a control valve 29 and a one-way valve 28. In this case also, the valve assemblies must be such that their one-way valves open/close under underpressures $P_\Delta$, which are described in the next two paragraphs. Thus, according to the most preferred embodiment of the invention, either the throttle duct has at its ends one-way valves, or the connecting duct 7 communicating with the throttle duct has a valve composition, but always one or the other.

In practical devices the cross-sectional area A3 of the gas supply orifices 21 of the gas ducts 2 is at maximum 0.2 $mm^2$, or preferably at maximum 0.07 $mm^2$. The above values concern gas ducts formed by mechanical machining, such as drilling, in which case orifices smaller than 0.005–0.015 $mm^2$ are difficult to achieve. By laser beam machining it may be possible to obtain smaller orifices. By using a porous material 36, considerably smaller gas ducts are obtained, in which case the pore size, i.e. the diameter of the cross-sectional area A3 of the gas supply orifices, is in general on average at minimum 1 $\mu$m, but typically at minimum 3 $\mu$m, and in general on average at maximum 1000 $\mu$m, but typically at maximum 500 $\mu$m, or at maximum 200 $\mu$m. On the basis of experiments it seems that porous pieces having pores with diameters in the order of 5–35 $\mu$m (=nominal pore size, in an individual piece the pore size has some size distribution) work excellently. It is thus clear that gas ducts of different diameters are obtained by different manufacturing techniques. The flow cross-sectional area A2 of the throttle duct 6, the total flow cross-sectional area $\Sigma$A2*a,b,c* of the open throttle ducts, and the total flow cross-sectional area $\Sigma$A2*a,b,c* of both the open throttle ducts and the throttle ducts possibly opening as the fuel flow increases are calibrated so that at the downstream ends 16*b* of the throttle ducts 6, 6*a*, 6*b*, 6*c* there will be during operation an underpressure $P_\Delta$ which is at least −0.1 bar (minimum value) and at most −0.6 bar, or preferably at most −0.5 bar (maximum value). With a smaller underpressure than −0.1 bar it is difficult to achieve substantial suction of gas/gas mixture G and effective dissolving of the gas in the liquid fuel F. On the other hand, under a greater underpressure than −0.6 bar the fuel F tends to foam, which causes a great deal of problems. These values are suitable for liquid fuels such as diesel oil and fuel oil. For kerosene and gasoline it is possible to use a slightly lower minimum value of underpressure $P_\Delta$, such as −0.07 bar. For heavy fuel oil it is possible to use higher minimum values and maximum values of underpressure $P_\Delta$, but it is to be noted that it is affected by the temperature and viscosity of the fuel oil. The values described above are based on the knowledge of today, and thus they are not to be regarded as limiting the invention. Furthermore, it is to be understood that various additives in the fuel may affect its flow properties and foaming tendency, thus changing the above-mentioned minimum and maximum values of underpressure $P_\Delta$. The minimum and maximum values of underpressure $P_\Delta$ are indeed to be determined in advance separately for each fuel type according to need, and the second flow cross-sectional areas A2, A2*a*, A2*b*, A2*c* of the throttle ducts and their ratios to the first flow cross-sectional areas A1*a*, A1*b* of the intake duct/outlet duct 3, 4 are to be calibrated correspondingly.

One throttle duct of the device according to the invention is preferably arranged by means of either one-way valves 35*a*, 35*b* of the throttle duct or a one-way valve of the valve assembly 30; 30*a*, 30*b*, 30*c* (e.g. 30*b* in FIGS. 6–7) of the connecting duct to open and respectively close under a very small underpressure $P_{\Delta 0}$, i.e. as soon as there appears liquid fuel flow F* in the throttle ducts. This underpressure could be, for example, within the range of 0.05–0.15 bar. This can thus in principle be regarded as always open during operation and as closed only when the flow F* is substantially zero. The underpressure $P_{\Delta 1}$, at the downstream end 16*b* of the throttle duct, which implements the opening/closing of the one-way valve(s) 35*b* or 35*a* of the throttle duct 6*a* or 6*b* or 6*c* defined as being the one which actually opens first or the opening/closing of the valve assembly 30*a* or 30*c*; 30*a* or 30*b*, defined as being the one which opens first, of the connecting duct 7 communicating with the throttle duct is calibrated within the range of 0.15–0.25 bar, whereas the underpressure $P_{\Delta 2}$, at the downstream end 16*b* of the throttle duct, which implements the opening/closing of the one-way valve(s) 35*a* or respectively 35*b* of the throttle duct 6*a* or 6*b* or 6*c* defined as being the one which possibly opens second, or the opening/closing of the valve assembly 30*a* or 30*c*; 30*a* or 30*b* of the connecting duct 7 communicating with the throttle duct, defined as opening second, is calibrated within the range of 0.3–0.4 bar. If only one opening/closing throttle duct or connecting duct is used, it is also possible to use an underpressure $P_{\Delta 3}$ between these values, for example, 0.2–0.3 bar in magnitude. These underpressures correspond to the situation given as an example in the preceding paragraph, i.e. diesel oil or fuel oil as such. The underpressures $P_{\Delta 1}$, $P_{\Delta 2}$ for the opening/closing of the throttle ducts 6, 6*a*, 6*b*, 6*c* or connecting ducts 7 defined to be the first and second to open/close must be defined in advance on the bases described in the preceding paragraph.

In addition to what has been stated above, the device according to the invention comprises an equalization chamber 10, common to the throttle ducts 6; 6*a*, 6*b*, 6*c* and disposed on the side of their downstream ends 16*b*, at a point before the outlet duct 4, the flow cross-sectional area A4 of the chamber being greater than the flow cross-sectional areas A1*a*, A1*b* of the fuel intake duct 3 or outlet duct 4. As has already been clearly noted above, this equalization chamber 10 is not located until at the distance of the downstream length L2 of the throttle ducts from the nearest gas duct 2. When necessary, within the downstream length L2 the throttle ducts may also be branched, in the manner shown in FIG. 10, as long as the cross-sectional area does not substantially change in the manner described above. If the distance between the gas ducts 2 closest to the equalization chamber and the downstream ends 16*b* of the throttle ducts is greater than the downstream length L2 according to the invention, within the throttle duct 6, 6*a*, 6*b*, 6*c* length exceeding it the cross-sectional area can be relatively freely expanded or reduced. By these means, by suitable combination and calibration, the fuel F containing dissolved gas/gas mixture G can be made more homogeneous in the equalization chamber 10. In any case the equalization chamber homogenizes the fuel.

Between the fuel F intake duct 3 and the throttle ducts, i.e. in the intake duct, there is a one-way valve 23, and respectively between the outlet duct 4 and the throttle ducts, i.e. in the outlet duct, there is a one-way valve 24, which valves open in the fuel flow direction F* and are closed relative to a flow in the opposite direction. The purpose of the one-way valve 24 on the outlet duct 4 side is to prevent back flow from the drive device direction when it is being stopped and while it is not operating. The pressure P2 by which it is opened is not critical, but it may be rather low. The purpose of the one-way valve 23 on the intake duct 3 side is to prevent the flowing of the fuel F, for example, under gravity from the fuel container into the device according to the invention. For this purpose the opening pressure P1 of the one-way valve 23 is, depending on the targeted use, calibrated so that the pressure of fuel above the device of the invention will not open it but opening is effected only by the underpressure produced by a fuel pump, not shown in the figures.

Furthermore, the device comprises, for example, in the frame part 31 a bypass duct 18, which extends from between the upstream ends 16*a* of the throttle ducts and the fuel intake duct 3 to between the downstream ends 16*b* of the throttle ducts and the fuel outlet duct 4. This bypass duct has a one-way valve 27, which opens in the fuel flow direction F under a predetermined underpressure $P_{\Delta 4}$, which is greater than the opening underpressure of any one-way valve 28 in the valve assemblies 30, 30*a*, 30*b*, 30*c* in the connecting ducts 7 and the opening underpressure of any one-way valve 35*a*, 35*b* in the throttle ducts. During an exceptional load situation of the drive device, i.e. during a power peak, this bypass duct thus lets the necessary additional fuel past the gas mixing sections of the mixing device according to the invention. The control valves 29 in the valve assemblies 30. 30*a*, 30*b*, 30*c* are preferably adjustable needle valves, which are set to provide the correct flow G* of gas G into each connecting duct 7 and throttle duct Thus, in addition to the opening of additional flow passages for gas on the basis of underpressure $P_{\Delta}$, it is possible to set the amount of gas/gas mixture from each gas flow passage after the passage has opened. The control possibilities are thus highly versatile.

Even though according to the invention it is preferable that the gas supply orifices 21, either as actual throughgoing gas ducts 2 in the manner shown in FIGS. 1–7 or as gas ducts effectively formed by pores indirectly with the help of connecting ducts 7 in the manner shown in FIGS. 8–11, are disposed on the first side of the said planes T; T1, T2, T3 running through the center line (8) of the throttle ducts 6; 6*a*, 6*b*, 6*c*, there may also be some gas supply orifices on the other side of the said planes. It is, however, believed that gas supply orifices must be on the first side of the planes in an amount of at least 70%, and preferably at least 80%, and typically 90% of the total cross-sectional area ΣA3 of the gas supply orifices 21.

The device according to the invention, described above, for sucking a gas or a gas mixture G and for mixing it with a liquid fuel F flowing in a flow duct provided with walls is highly reliable in operation, for example, for the reason that therein the control of the suction and supply of the gas/gas mixture takes place by means of mechanical controls in one compact device, i.e. one-way valves operated by certain pressure differences. The opening and closing pressures of the one-way valves are set fixedly in each one-way valve by using counter-springs having a specific spring force. The pressure differences of opening/closing are thus based on a precise spring force. The device according to the invention, when supplying in different operating situations the correct amount of air, and at the same time the correct amount of oxygen, into a liquid fuel, decreases fuel consumption, renders the combustion more effective, and reduces emissions.

What is claimed is:

1. A device for sucking a gas or a gas mixture and for mixing it with a liquid fuel flowing in a flow duct provided with walls, the device comprising:

a liquid intake duct and outlet duct, which have first flow cross-sectional areas;

a throttle section between the intake and outlet ducts comprising at least one elongate throttle duct for the flowing liquid fuel; and at least one gas duct transverse to a center line of the throttle duct, which gas duct opens as a gas supply orifice into the throttle duct, said throttle duct forming for the flow a second flow cross-sectional area, which is substantially smaller than said first flow cross-sectional areas, and extending with a substantially unchanging flow cross-sectional area from the point of said gas supply orifice to a downstream length on the downstream side of the liquid flow, wherein the throttle section further comprises as a combination:

a second one-way valve in the outlet duct arranged to open with a second pressure value; and said at least one gas duct opens as a gas supply orifice/gas supply orifices into the throttle duct at least substantially on a first side of a plane running through the center line of the throttle duct, and continues as a connecting duct outside the throttle duct to the opposite side of said plane and further to the gas mixture/gas source.

2. A device according to claim 1, further comprising at least two throttle ducts, which have second flow cross-sectional areas, the sum of which is substantially smaller than said first flow cross-sectional areas.

3. A device according to claim 2, wherein said several throttle ducts are coupled in parallel relative to the liquid flow, and into each throttle duct there opens at least one gas duct transverse to the center line of the throttle duct via at least one gas supply orifice.

4. A device according to claim 1, further comprising at least two gas ducts at a distance parallel to the downstream length of the throttle duct and/or parallel to the circumference of the throttle duct and opening into each throttle duct, and these at least two gas ducts communicating with either one or several connecting ducts.

5. A device according to claim 4, wherein said connecting ducts comprise between the gas supply orifice(s) and the gas mixture/gas source a valve assembly, which is made up of either a control valve or a combination of a one-way valve and a control valve, which valve assembly is arranged to open and close under a predetermined underpressure at the downstream end of the throttle duct.

6. A device according to claim 4, wherein each connecting duct of gas ducts opening into different throttle ducts comprises between the gas supply orifice(s) and the gas mixture/gas source its own valve assembly, which is made up of a combination of a one-way valve and a control valve, whereupon each valve assembly is arranged to open and close under an underpressure substantially deviating from those of the other valve assemblies at the downstream end of the throttle ducts.

7. A device according to claim 2, wherein the second and any further of the throttle ducts comprises at its liquid flow upstream end and/or downstream end a one-way valve, whereupon said one-way valves of the different throttle ducts are arranged to open and close under an underpressure, substantially deviating from those of the other valve assemblies at the downstream end of the throttle ducts.

8. A device according to claim 1, wherein the cross-sectional area of the gas supply orifices of the gas ducts is within the range of at minimum 0.005 $mm^2$ and at maximum 0.2 $mm^2$.

9. A device according to claim 1, wherein the flow cross-sectional area of the throttle duct, the total flow cross-sectional area of the open throttle ducts, and the total flow cross-sectional area of the open throttle ducts and those throttle ducts which optionally open as the fuel flow increases has been calibrated to maintain at the downstream ends of the throttle ducts an underpressure which is at minimum −0.1 bar and at maximum −0.6 bar.

10. A device according to claim 7, wherein said one-way valve(s) of one throttle duct is/are arranged to open at a throttle duct downstream end underpressure which is within the range of 0.15–0.25 bar; and the one-way valve(s) of a possible other throttle duct is/are arranged to open at a throttle duct downstream end underpressure which is 0.3–0.4 bar.

11. A device according to claim 7, wherein said valve assembly of a connecting duct communicating with the throttle duct is arranged to open at a throttle duct downstream end underpressure which is within the range of 0.15–0.25 bar; and the valve assembly of a possible other connecting duct communicating with the throttle duct is arranged to open at a throttle duct downstream end underpressure which is 0.3–0.4 bar.

12. A device according to claim 1, wherein said second flow cross-sectional area of a throttle duct extends with substantially the same flow cross-sectional area to the distance of a downstream length which is at minimum equal to, or at minimum twice the mean diameter of the throttled flow cross-sectional area.

13. A device according to claim 1, wherein said second flow cross-sectional area changes within the downstream length at maximum 30%.

14. A device according to claim 1, further comprising an equalization chamber common to the throttle ducts and located between their downstream ends and the outlet duct, the flow cross-sectional area of the chamber being greater than the flow cross-sectional areas of the fuel intake duct and outlet duct.

15. A device according to claim 1, further comprising a bypass duct, which extends from between the upstream ends of the throttle ducts and the fuel intake duct to between the downstream ends of the throttle ducts and the fuel outlet duct.

16. A device according to claim 15, wherein said bypass duct has a one-way valve which opens in the fuel flow direction under a predetermined underpressure.

17. A device according to claim 1, wherein said gas supply orifices of the gas ducts open into the throttle ducts entirely on the first side of a plane running through the throttle duct center line and within a sector the sides of which form relative to said plane an angle which is at minimum 10°.

18. A device according to claim 17, further comprising one-way valves between the fuel intake duct and respectively the outlet duct and the throttle ducts, which valves open in the fuel flow direction.

19. A device according to claim 1, wherein several gas supply orifices of a plurality of gas ducts open into each throttle duct within a partial area of the throttle duct length and the circumference, and the several gas intake apertures of these gas ducts communicate with either one or several connecting ducts.

20. A device according to claim 19, wherein said plurality of gas ducts comprises rows of open pores in a porous material.

21. A device according to claim 20, wherein the throttle section surrounding the throttle duct(s) is entirely or in part made up of said porous material, the open pores of which form said gas supply orifices.

22. A device according to claim 21, wherein said connecting ducts have portions open to the gas intake apertures in the porous material only on said first side of a plane running through the center line of the throttle duct.

23. A device according to claim 21, wherein said porous material is a piece:

being located between the throttle duct and the connecting duct substantially on said first side of said plane through the center line of the throttle duct; or surrounding the throttle duct on each side, in which case the connecting duct(s) surround(s) it substantially on said first side of said plane through the center line of the throttle duct.

24. A device according to claim 1, further comprising a first one-way valve in the intake duct arranged to open at a first pressure value.

25. A device according to claim 21, wherein the mean diameter of the open pores of the porous material is at minimum 1 $\mu$m and at maximum 1000 $\mu$m.

26. A device for sucking a gas or a gas mixture and for mixing it with a liquid fuel flowing in a flow duct provided with walls, the device comprising:

a liquid intake duct and outlet duct, which have first flow cross-sectional areas;

a throttle section between the intake and outlet ducts comprising at least one elongate throttle duct for the flowing liquid fuel; and at least one gas duct transverse to a center line of the throttle duct(s), which gas duct(s) open(s) as gas supply orifice(s) into the throttle duct(s), said throttle duct(s) forming for the flow a second flow cross-sectional area, which is substantially smaller than said first flow cross-sectional areas, and extending with a substantially unchanging flow cross-sectional area from the point of said gas supply orifice to a downstream length on the downstream side of the liquid flow, wherein:

within the throttle section said at least one gas duct opens as a gas supply orifice/gas supply orifices into the throttle duct(s) at least substantially on a first side of a plane running through the center line(s) of the throttle duct(s), and continues as a connecting duct outside the throttle duct to the opposite side of said plane(s) and further to the gas mixture/gas source; and each connecting duct of said at least one gas duct opening into said throttle duct(s) comprise(s) between the gas supply orifice(s) and the gas mixture/gas source its own valve assembly, which is made up of a combination of a one-way valve and a control valve, whereupon each valve assembly is arranged to open and close under an underpressure.

27. A device according to claim 26, further comprising a first one-way valve in the intake duct arranged to open at a first pressure value and/or a second one-way valve in the outlet duct arranged to open with a second pressure value, which valves open in the fuel flow direction.

28. A device according to claim 26, wherein said gas ducts are open pores in a porous material, and said open pores form said gas supply orifices.

* * * * *